US008917297B2

(12) United States Patent
Dong et al.

(10) Patent No.: US 8,917,297 B2
(45) Date of Patent: Dec. 23, 2014

(54) PEN-BARREL HEAT TRANSFERRING DEVICE

(71) Applicant: Beifa Group Co., Ltd., Ningbo, Zhejiang (CN)

(72) Inventors: Cailiang Dong, Ningbo (CN); Xianghong Wang, Ningbo (CN)

(73) Assignee: Beifa Group Co., Ltd., Ningbo (CN)

( * ) Notice: Subject to any disclaimer, the term of this patent is extended or adjusted under 35 U.S.C. 154(b) by 0 days.

(21) Appl. No.: 13/717,655

(22) Filed: Dec. 17, 2012

(65) Prior Publication Data

US 2013/0169730 A1 Jul. 4, 2013

(30) Foreign Application Priority Data

Dec. 29, 2011 (CN) ..... 2011 1 0450187

(51) Int. Cl.

| | |
|---|---|
| ***B41J 2/315*** | (2006.01) |
| ***B41J 2/32*** | (2006.01) |
| ***B41F 16/00*** | (2006.01) |
| ***B41F 17/18*** | (2006.01) |
| ***B41F 17/22*** | (2006.01) |
| *B41M 5/035* | (2006.01) |
| *B41M 5/382* | (2006.01) |

(52) U.S. Cl.

CPC ..... *B41J 2/315* (2013.01); *B41F 16/0026* (2013.01); *B41F 17/18* (2013.01); *B41F 17/22* (2013.01); *B41M 5/035* (2013.01); *B41M 5/38221* (2013.01)

USPC ..... 347/171

(58) Field of Classification Search

None

See application file for complete search history.

(56) References Cited

U.S. PATENT DOCUMENTS

| | | | | |
|---|---|---|---|---|
| 4,431,102 | A | 2/1984 | Bittner | |
| 4,635,338 | A | 1/1987 | Walsh | |
| 5,172,994 | A | 12/1992 | Brown | |
| 5,469,204 | A * | 11/1995 | Kim | 347/218 |
| 5,938,361 | A | 8/1999 | Yasunaga | |
| 6,425,702 | B1 | 7/2002 | Brunetti | |
| 6,755,222 | B2 | 6/2004 | Kondo | |
| 8,061,791 | B2 * | 11/2011 | Iftime et al. | 347/1 |
| 8,123,424 | B2 | 2/2012 | Chang | |
| 8,226,073 | B2 | 7/2012 | Li | |
| 2010/0229737 | A1 * | 9/2010 | Ouchi | 101/4 |

* cited by examiner

*Primary Examiner* — Matthew Luu

*Assistant Examiner* — Erica Lin

(74) *Attorney, Agent, or Firm* — Christensen O'Connor Johnson Kindness PLLC

(57) ABSTRACT

A heat transferring device for a workpiece such as a pen barrel includes a pneumatic mechanism, a roller mechanism, a heating mechanism, and a rolling mechanism. The pneumatic mechanism is connected with the roller mechanism. The rolling mechanism rotates the pen barrel, and the roller mechanism includes an elastic force applying mechanism that applies an elastic force on the pen barrel during rotation. As the rolling mechanism rotates the pen barrel, the elastic force applying mechanism applies an elastic force to the pen barrel that keeps a roller wheel in contact with respective faces of the pen barrel during rotation. Thus, the force that the elastic force applying mechanism applies to the pen barrel is uniform and the respective faces of the pen barrel receive a uniform force. Therefore, the device can heat transfer designs on pen barrels having non-circular as well as circular shapes.

16 Claims, 4 Drawing Sheets

PEN-BARREL HEAT TRANSFERRING DEVICE

TECHNICAL FIELD

The present disclosure relates to a heat transferring device, and in particular a pen-barrel heat transferring device for printing.

BACKGROUND

A traditional pen barrel generally has a circular shape. In order to improve the aesthetic appearance of the pen, a pattern is often heat transferred onto the surface of the pen barrel. A conventional heat transferring device generally includes a pneumatic mechanism, a roller mechanism for heat transferring on the pen barrel, and a heating mechanism for heating the roller mechanism. When heat transferring on a pen barrel, the pneumatic mechanism pushes the roller mechanism downwards to contact the pen barrel and rotates the pen barrel in order to heat transfer a pattern from a pattern paper onto the outer surface of the pen barrel.

When a pen barrel has a circular shape, the roller mechanism stays in contact with the pen barrel during heat transferring, so a uniform force is applied along the length of the pen barrel. Since each face of the pen barrel receives a uniform force, the pen barrel rolls at an even speed.

As pen manufacturing technology improves, the aesthetic appearance of the pen also improves, and various shapes of pen barrels have appeared, such as triangle, quadrangle, or other irregular shapes. When heat transferring on pen barrels of triangle, quadrangle, or other irregular shapes, the roller mechanism cannot keep in contact with each face of the pen barrel as the conventional roller wheel is made of a very hard material. The result is that the roller mechanism cannot apply a uniform force on different faces of the pen barrel. Because each face of the pen barrel receives a nonuniform force, the roller mechanism cannot smoothly roll the pen barrel. Therefore, it is difficult to complete heat transferring and printing.

SUMMARY

A solution to the technical problem of providing a pen-barrel heat transferring device that can apply a uniform force on each face of the pen barrel during heat transferring and is suitable for various shapes of pen barrels is solved by embodiments of the invention.

In order to solve the problem above, embodiments disclosed herein provide a pen-barrel heat transferring device including a roller mechanism and a rolling mechanism. The roller mechanism is adapted to apply heat and pressure from a roller wheel on a workpiece supported by the rolling mechanism. The roller mechanism includes an elastic force applying mechanism that elastically conforms to a shape of the workpiece. Also, instead of the workpiece being rotated by a roller wheel of the roller mechanism, the rolling mechanism is adapted to rotate the workpiece and also support the workpiece. So, the rotating workpiece causes the roller wheel to rotate.

The roller mechanism may include a roller wheel, and the elastic force applying mechanism may include a deformable rubber portion on the exterior of the roller wheel. The deformable rubber portion may cover the circumference and length of the exterior of the roller wheel.

The rolling mechanism may be connected to a driver adapted to rotate the workpiece.

The workpiece can be a pen barrel having a non-circular cross-sectional shape.

The roller mechanism may include a suspension frame, wherein the suspension frame includes an upper horizontal rod and a lower horizontal rod, and the elastic force applying mechanism is a rubber wheel having an elasticity sufficient to conform to a shape of the workpiece, wherein the rubber wheel is fitted over the lower horizontal rod, and the upper horizontal rod is coupled with the pneumatic mechanism.

In another embodiment, the elastic force applying mechanism includes a spring in contact with the roller mechanism, wherein the spring is adapted to elastically conform the roller mechanism to a shape of the workpiece.

The roller mechanism may include a rubber wheel and a suspension frame, wherein the suspension frame includes an upper horizontal rod and a lower horizontal rod, the rubber wheel is fitted over the lower horizontal rod, and the upper horizontal rod is coupled with a pneumatic mechanism via the spring.

The roller mechanism may include a roller wheel, and the elastic force applying mechanism may include a deformable rubber portion on the exterior of the roller wheel and also a spring in contact with the roller mechanism, wherein the rubber portion and the spring are both adapted to elastically conform to a shape of the workpiece.

The rolling mechanism may include a motor, a rotating wheel coupled to a die core rod, a base plate, and a base. The base is mounted on the base plate. The die core rod extends through the base and is coupled with the base via a shaft coupling. The rotating wheel is mounted at one end of the die core rod and is connected with the motor via a belt. The other end of the die core rod is adapted to support the workpiece.

A height-adjustable pneumatic pulley supporting mechanism may also be provided on the base plate opposite from the base to support the die core rod and the workpiece.

A pneumatic mechanism may include a cylinder with a shaft, and the shaft is coupled to the roller mechanism.

The heating mechanism connected to the roller mechanism may include an optical heating cover or an electric heating cover provided on the roller wheel.

In at least one embodiment, the roller mechanism includes a roller wheel, and the roller wheel is adapted to rotate upon applying pressure to a rotating workpiece.

In some embodiments, the heat transferring device is adapted to heat transfer print on pen barrels.

In comparison with prior art heat transferring devices, advantages of the disclosed embodiments may include the following. During heat transferring, the rolling mechanism rotates a pen barrel, and the elastic force applying mechanism of the roller mechanism applies an elastic force to keep the roller mechanism in contact with changing surface shapes of the pen barrel. Thus, the elastic force applying mechanism applies a uniform force at each different face of the pen barrel. Therefore, the device can heat transfer print the pen barrels of various non-circular shapes.

When the roller mechanism further includes a suspension frame, the suspension frame includes an upper horizontal rod and a lower horizontal rod. The elastic force applying mechanism is a rubber wheel with elasticity. The rubber wheel is fitted over the lower horizontal rod, and the upper horizontal rod is coupled with the pneumatic mechanism. The rubber wheel has elasticity. Therefore, as the rubber wheel contacts the pen barrel in order to perform heat transferring, the rubber wheel will elastically deform according to the changing shape of the rotating pen barrel ensuring that the rubber wheel stays in contact with respective faces of the pen barrel and the respective faces of the pen barrel receive a uniform force.

When the roller mechanism further includes a rubber wheel and a suspension frame, the suspension frame includes an upper horizontal rod and a lower horizontal rod connected to the upper horizontal rod, and the rubber wheel is fitted over the lower horizontal rod. The elastic force applying mechanism is a spring, and the upper horizontal rod is coupled with the pneumatic mechanism via the spring. During heat transferring, the pneumatic mechanism pushes the suspension frame downwards via the spring. The suspension frame is lowered down and the rubber wheel presses against the rotating pen barrel. The spring will elastically deform according to the changing shape of the rotating pen barrel ensuring that the rubber wheel stays in contact with respective faces of the pen barrel and the respective faces of the pen barrel receive a uniform force.

When the roller mechanism further includes a suspension frame, the suspension frame includes an upper horizontal rod and a lower horizontal rod connected to the upper horizontal rod. The elastic force applying mechanism includes a rubber wheel with elasticity and a spring. The rubber wheel is fitted over the lower horizontal rod, and the upper horizontal rod is coupled with the pneumatic mechanism via the spring. During heat transferring, the pneumatic mechanism pushes the suspension frame downwards via the spring so that the rubber wheel presses on and performs heat transferring on the rotating pen barrel. The spring and the rubber wheel will elastically deform according to the changing shape of the rotating pen barrel ensuring that the rubber wheel stays in contact with respective faces of the pen barrel and the respective faces of the pen barrel receive a uniform force.

When the rolling mechanism includes a motor, a rotating wheel, a base plate, a base, and a die core rod, the pen barrel is mounted on the die core rod and is rotated by the motor driving the rotating wheel, which in turn rotates the die core rod and pen barrel. Therefore, the pen barrel rotates the roller wheel. The structure is simple and convenient to operate.

When the rolling mechanism further includes a pneumatic pulley supporting mechanism, and if the pen barrel is very long, one end thereof may be fitted over the die core rod, and the other end thereof may be located at the pneumatic pulley supporting mechanism. Thus, the horizontal position of the pen barrel during heating transferring is ensured. Further, the height of the pneumatic pulley supporting mechanism is adjustable, so the height of the pneumatic pulley supporting mechanism may be adjusted instantly according to the diameter of the pen barrel, thus facilitating mounting and dismounting of the pen barrel.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
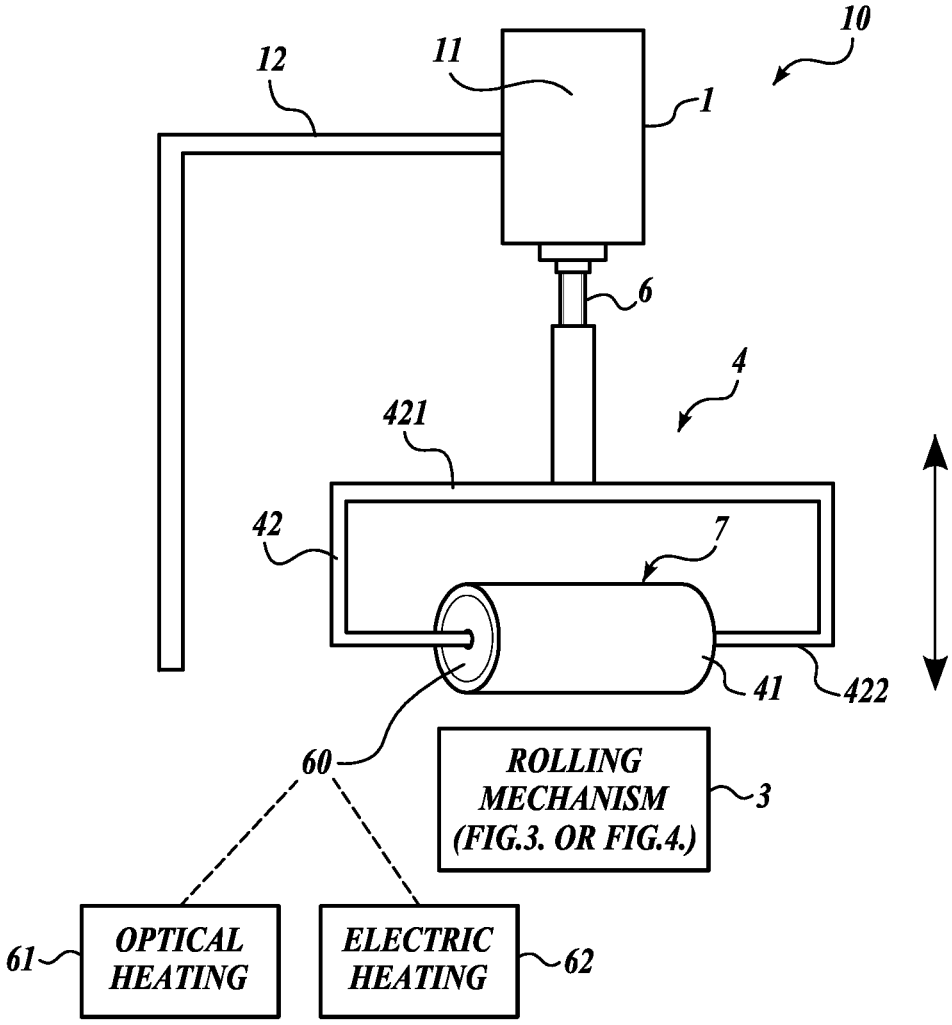
FIG. 1 schematically shows one embodiment of a heat transferring device.
Figure 3:
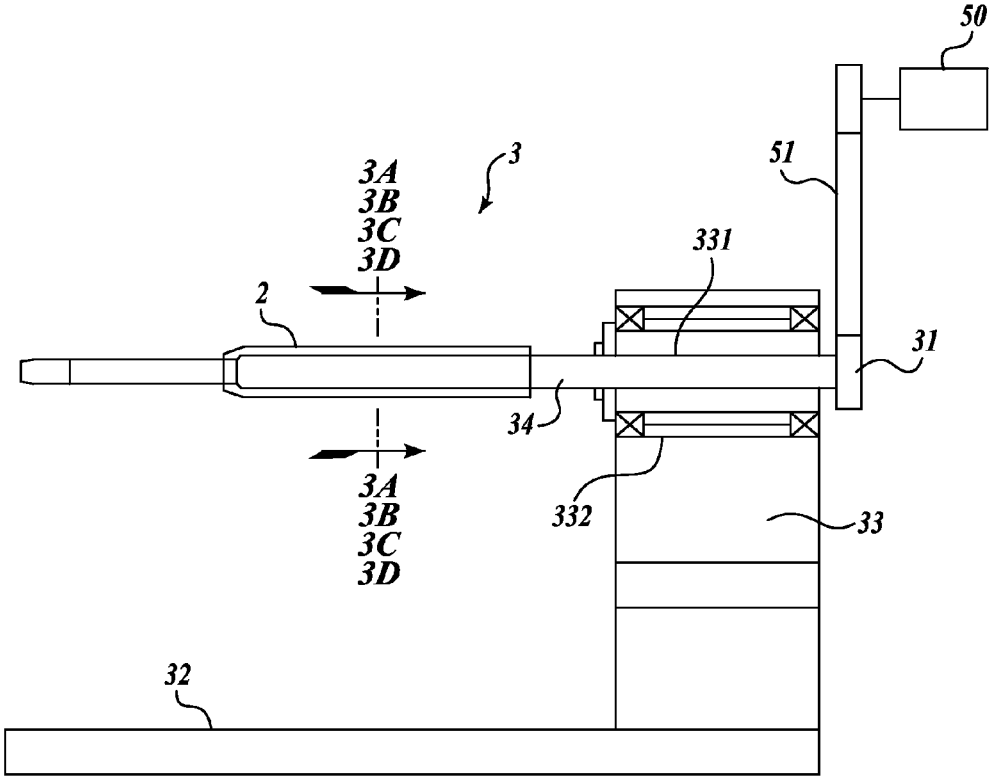
FIG. 3 is a schematic sectional view of a rolling mechanism.

With reference to FIG. 1 and FIG. 3, one embodiment of a heat transferring device 10 includes a pneumatic mechanism 1, a roller mechanism 4 connected with the pneumatic mechanism 1, a heating mechanism 60, and a rolling mechanism 3. The rolling mechanism 3 (shown in more detail in FIG. 3) is for rotating a workpiece, such as pen barrel 2. The heat transferring device 10 may be used for heat transfer printing of workpieces, including, but not limited to, pen barrels and the like. While a pen barrel is used in the description of the various embodiments, it is to be appreciated that the heat transferring device 10 is not thereby limited, as a pen barrel is merely one illustrative example of a workpiece.

The roller mechanism 4 includes a roller wheel 7 for the application of heat and pressure to the workpiece 2. The roller wheel 7 may only passively rotate. That is, the rolling mechanism 3 rotates the pen barrel, and the roller wheel 7 rotates when applying pressure on the pen barrel. The roller mechanism 4 includes an elastic force applying mechanism 41 for applying an elastic force to the pen barrel. The elastic force applying mechanism 41 as used herein can be one or more members that allow the roller wheel 7 to elastically yield or conform to changes in the shape of the pen barrel to maintain pressure on the pen barrel even when the pen barrel is a shape other than circular. As described further below, in this embodiment, the elastic force applying mechanism is an elastic rubber portion 41 on the exterior of the roller wheel 7.

The pneumatic mechanism 1 includes a cylinder 11 and a cylinder bracket 12 to which the cylinder 11 is attached. The heating mechanism 60 can be an optical heating cover 61 or an electric heating cover 62.

In some embodiments, the wheel 7 is made with an inner metal core and an outer rubber cylinder. In some embodiments, the inner metal core can be electrically heated. The roller mechanism 4 further includes a suspension frame 42. The suspension frame 42 includes an upper horizontal rod 421 and a lower horizontal rod 422. The lower horizontal rod 422 connects to the upper horizontal rod 421 at both ends thereof with vertical support rods. In this embodiment, the elastic force applying mechanism 41 is the rubber portion 41 placed on the exterior of the roller wheel 7. For example, the roller wheel 7 can include a metal inner core that is heated and an outer rubber portion 41 that extends over the circumference and length of the metal core and behaves as the elastic force applying mechanism. Alternately, the entirety or a majority of the roller wheel 7 can be made from the elastic deformable rubber portion 41. The rubber portion 41 has sufficient elasticity that allows the rubber portion 41 to deflect and conform to changes in the shape of the pen barrel as the pen barrel rotates. The rubber portion 41 may have a hardness of 45~65 Shore A durometer, for example. Exemplary rubber materials may include silicone, polyurethane, polyether, combinations of polyurethane and polyethers, and others. The upper horizontal rod 421 is rigidly coupled with the cylinder shaft 6 of the cylinder 11.

Figure 3A:
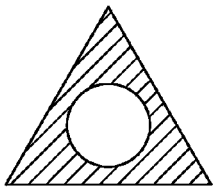
FIGS. 3A, 3B, 3C, and 3D schematically show various shapes of pen barrels.
Figure 3B:
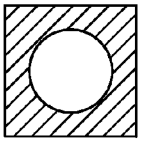
Figure 3C:
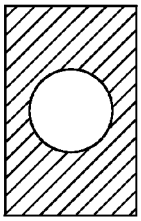
Figure 3D:
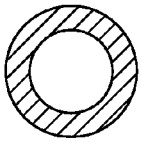

With reference to FIG. 3, the rolling mechanism 3 includes a motor 50, a rotating wheel 31, a base plate 32, a base 33, and a die core rod 34. The base 33 is mounted at one end of the base plate 32, and extends vertically from the base plate 32. A horizontal shaft hole 331 is provided in the upper section of the base 33. The die core rod 34 extends through the horizontal shaft hole 331 and is coupled with the base 33 via shaft coupling 332, such that the majority of the die core rod 34 is cantilevered over the base 32. The die core rod 34 is generally supported horizontally, and parallel to the roller wheel 7. The rolling mechanism 3 is placed below the roller wheel 7, such that the roller wheel 7 can be lowered to apply heat and pressure (an elastic force) on the pen barrel 2 supported by the die core rod 34. A pen barrel is used as a representative workpiece 2, with FIGS. 3A, 3B, and 3C showing shapes other than circular including a triangle and two quadrangles, wherein one is a square shape and the other is a rectangle. FIG. 3D illustrates a circular shape. The driving wheel 31 is rigidly fixed to one end of the die core rod 34 that protrudes past the shaft coupling 332. The driving wheel 31 is in turn connected with the motor 50 via a belt 51. The pen barrel 2 to be heat transferred is placed on the cantilevered end of the die core rod 34. The pen barrel 2 is fixed to the die core rod 34 such that the pen barrel 2 rotates with the die core rod 34.

The operating procedure of the pen-barrel heat transferring device 10 is as follows. Before heat transferring, the pen barrel 2 is fixed on the die core rod 34, and a pattern paper is provided on the surface of the pen barrel 2. The pattern paper may include heat-sensitive ink. Then, the heating mechanism 60 is started to heat the roller wheel 7. The temperatures for heat transfer printing of particular printing inks are known in the art. Next, the cylinder 11 is started and pushes the suspension frame 42 downwards so that the roller wheel 7 is lowered and presses against the pen barrel 2 through the pattern paper. The motor 51 rotates the wheel 31 and the die core rod 34, which in turn causes the pen barrel 2 and the roller wheel 7 to rotate in opposite directions. The heat and pressure applied by the roller wheel 7 causes the pattern on the pattern paper to transfer onto the surface of the pen barrel 2. If the pen barrel 2 is circular, the roller wheel 7, particularly, the rubber portion 41, will uniformly deform as the pen barrel 2 rotates. If the pen barrel 2 is a shape other than a circle, such as a triangle, quadrangle, or other irregular shape, the rubber portion 41 will elastically deform according to the shape of the respective faces of the pen barrel 2 as the pen barrel rotates. The rubber portion 41 will deform more when the roller wheel 7 presses against a corner of the triangle or quadrangle, for example. The rubber portion 41 ensures that the roller wheel 7 maintains contact and pressure on the respective faces of the pen barrel 2 during rotation so that heat transfer can occur between the roller wheel 7 and the pen barrel 2. Furthermore, the respective faces of the pen barrel 2 can receive a uniform force.

Figure 2:
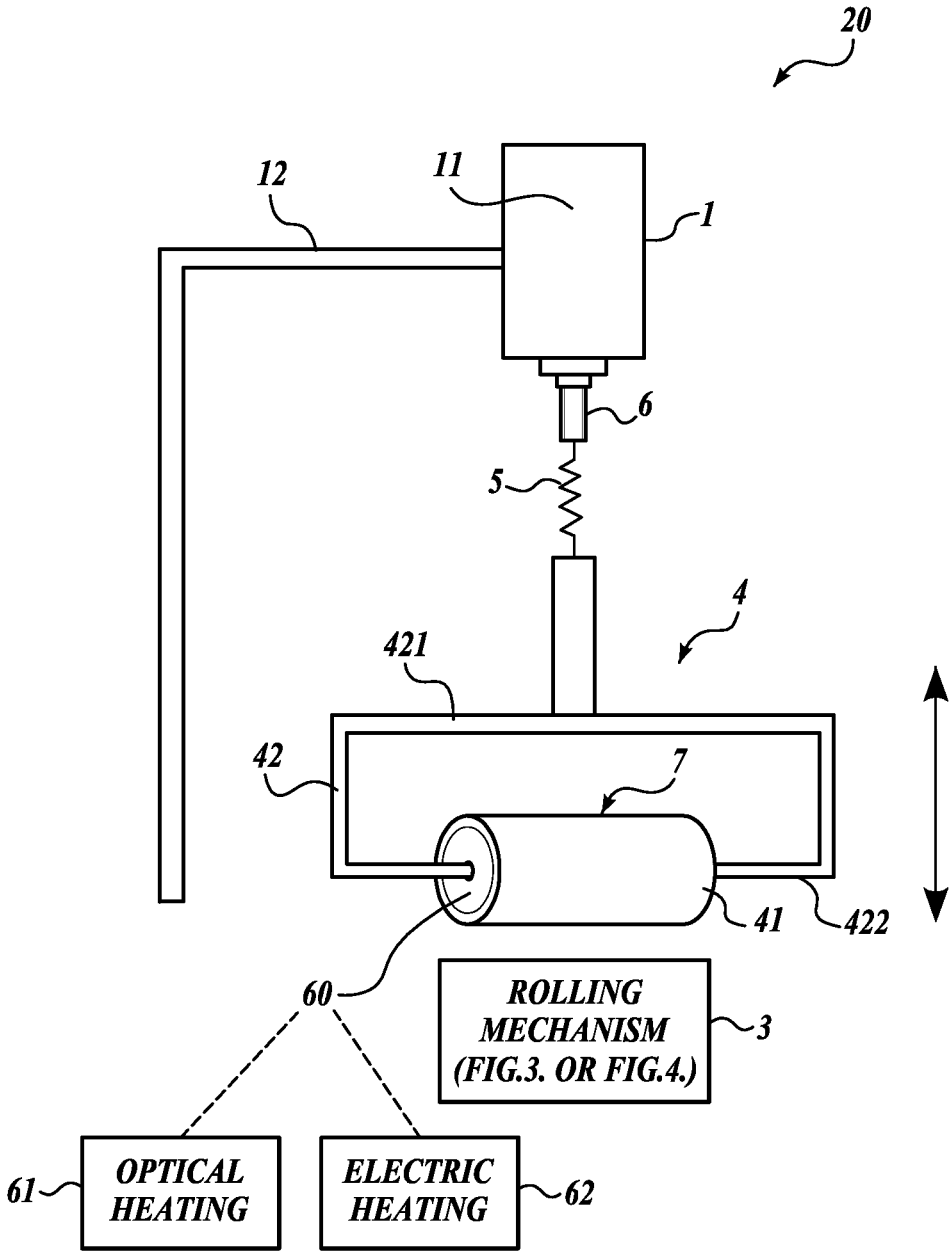
FIG. 2 schematically shows another embodiment of a heat transferring device.

With reference to FIG. 2 and FIG. 3, wherein like numbers represent like parts of the embodiment shown in FIG. 1, an embodiment of a pen-barrel heat transferring device 20 includes a pneumatic mechanism 1, a roller mechanism 4 connected with the pneumatic mechanism 1, a heating mechanism 60, and a rolling mechanism 3. The rolling mechanism 3 (shown in detail in FIG. 3) is for rotating the workpiece, such as a pen barrel 2. The heat transferring device 20 may be used for heat transfer printing of workpieces, including, but not limited to, pen barrels and the like. While a pen barrel is used in the description of the various embodiments, it is to be appreciated that the heat transferring device 20 is not thereby limited, as a pen barrel is merely one illustrative example of a workpiece.

The roller mechanism 4 includes a roller wheel 7 for the application of heat and pressure to the workpiece 2. The roller wheel 7 may only passively rotate. That is, the rolling mechanism 3 rotates the pen barrel, and the roller wheel 7 rotates when applying pressure on the pen barrel. The roller mechanism 4 includes an elastic force applying mechanism 5 for applying an elastic force to the pen barrel with the rolling mechanism. The elastic force applying mechanism 5 as used herein can be one or more members that allow the roller wheel 7 to elastically yield or conform to changes in the shape of the pen barrel to maintain pressure on the pen barrel even when the pen barrel is a shape other than circular. As described further below, in this embodiment, the elastic force applying mechanism is a spring 5.

The pneumatic mechanism 1 includes a cylinder 11 and a cylinder bracket 12 to which the cylinder 11 is attached. The heating mechanism 60 can be an optical heating cover 61 or an electric heating cover 62.

In some embodiments, the wheel 7 is made with an inner metal core and an outer rubber cylinder 41. In some embodiments, the inner metal core can be electrically heated. In some embodiments, the roller wheel 7 can be made wholly or entirely from rubber. The roller mechanism 4 further includes a suspension frame 42, and the suspension frame 42 includes an upper horizontal rod 421 and a lower horizontal rod 422. The lower horizontal rod 422 connects to the upper horizontal rod 421 at both ends thereof with vertical support rods. The roller wheel 7 is fitted over the lower horizontal rod 422. In this embodiment, the elastic force applying mechanism is the spring 5. The spring 5 allows the roller mechanism 4, including the frame and roller wheel 7, to adjust position, such as height, based on changes in the shape of the pen barrel 2. The upper horizontal rod 421 is coupled with the cylinder shaft 6 of the cylinder 11 via the spring 5. The spring 6 can take the form of a compression coil spring, a leaf spring, a gas spring, and others, or any combination.

With reference to FIG. 3, the rolling mechanism 3 includes a motor 50, a rotating wheel 31, a base plate 32, a base 33 and a die core rod 34. The base 33 is mounted at one end of the base plate 32, and extends vertically from the base plate 32. A horizontal shaft hole 331 is provided in the upper section of the base 33. The die core rod 34 extends through the horizontal shaft hole 331 and is coupled with the base 33 via shaft coupling 332, such that the majority of die core rod 34 is cantilevered over the base 32. The die core rod 34 is generally supported horizontally, and parallel to the roller wheel 7. The rolling mechanism 3 is placed below the roller wheel 7, such that the roller wheel 7 can be lowered to apply heat and pressure (an elastic force) on the pen barrel 2 supported by the die core rod 34. A pen barrel is used as a representative workpiece 2, with FIGS. 3A, 3B, and 3C showing shapes other than circular including a triangle and two quadrangles, wherein one is a square shape and the other is a rectangle. FIG. 3D illustrates a circular shape. The driving wheel 31 is rigidly fixed to one end of the die core rod 34 that protrudes past the shaft coupling 332. The driving wheel 31 is in turn connected with the motor 50 via a belt 51. The pen barrel 2 to be heat transferred is placed on the cantilevered end of the die core rod 34. The pen barrel 2 is fixed to the die core rod 34 such that the pen barrel 2 rotates with the die core rod 34.

The operating procedure of the pen-barrel heat transferring device 20 is as follows. Before heat transferring, the pen barrel 2 is fixed on the die core rod 34, and a pattern paper is provided on the surface of the pen barrel 2. The pattern paper may include heat-sensitive ink. Then, the heating mechanism 60 is started to heat the roller wheel 7. The temperatures for heat transfer printing of particular printing inks are known in the art. Next, the cylinder 11 is started and pushes the suspension frame 42 downwards via the spring 5 so that the roller wheel 7 is lowered and presses against the pen barrel 2 through the pattern paper. The motor 51 rotates the wheel 31 and the die core rod 34, which in turn causes the pen barrel 2 and the roller wheel 7 to rotate in opposite directions. The heat and pressure applied by the roller wheel 7 causes the pattern on the pattern paper to transfer onto the surface of the pen barrel 2. If the pen barrel 2 is circular, the spring 5 will uniformly deform as the pen barrel 2 rotates. If the pen barrel 2 is a shape other than a circle, such as a triangle, quadrangle, or other irregular shape, the spring 5 will elastically deform according to the shape of respective faces of the pen barrel 2 as the pen barrel rotates. The spring 5 will deform more when the roller wheel 7 presses against a corner of the triangle or quadrangle, for example. The spring 5 ensures that the roller wheel 7 maintains contact with the respective faces of the pen barrel 2 during rotation so that heat transfer can occur between the roller wheel 7 and the pen barrel 2. Furthermore, the respective faces of the pen barrel 2 can receive a uniform force.

The structure of another embodiment of a heat-transferring device disclosed herein is similar to that of the embodiment shown in FIG. 2. In this embodiment, the elastic force applying mechanism may include both an elastic rubber portion 41 on the roller wheel 7 in addition to the spring 5. The hardness of the rubber portion 41 on the wheel 7 can have a durometer between 55~65 Shore A durometer. The wheel 7 can thus elastically deform during heat transferring in combination with the spring 5.

Figure 4:
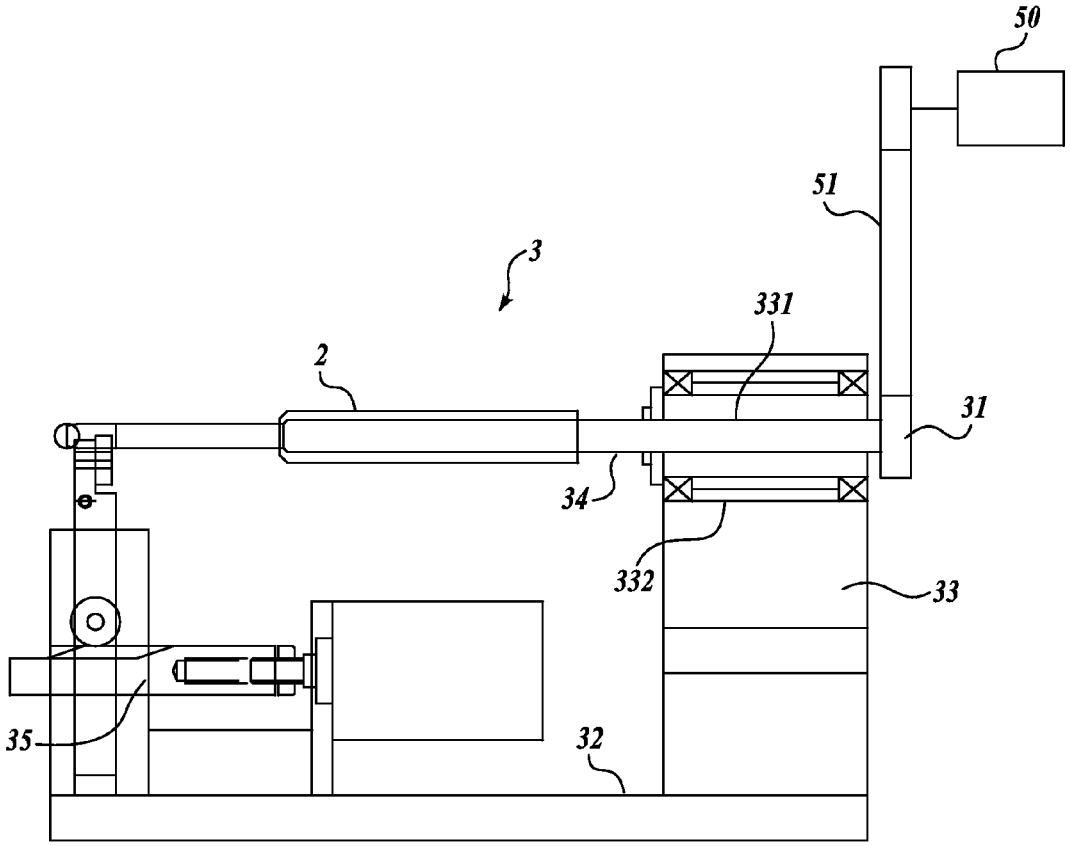
FIG. 4 is a schematic sectional view of a rolling mechanism.

As shown in FIG. 4, a height-adjustable pneumatic pulley supporting mechanism 35 can be provided to support the cantilevered end of the die core rod 34 and pen barrel 2. The height-adjustable pneumatic pulley supporting mechanism 35 can be provided on all the above-described heat transferring devices 10 and 20. The height-adjustable pneumatic pulley supporting mechanism 35 is placed on the base plate 32 of the rolling mechanism 3. As is apparent from FIG. 4, if the pen barrel 2 were to be very long, the pneumatic pulley supporting mechanism 35 and the die core rod 34 may support the pen barrel 2 simultaneously, thus the horizontal position of the pen barrel 2 during heat transferring is ensured. The pneumatic pulley supporting mechanism 35 may include an elevating mechanism and two parallel pulleys provided at the upper end of the elevating mechanism such that the pen barrel 2 is supported by the two pulleys simultaneously.

While illustrative embodiments have been illustrated and described, it will be appreciated that various changes can be made therein without departing from the spirit and scope of the invention.

The embodiments of the invention in which an exclusive property or privilege is claimed are defined as follows:

1. A heat transferring device, comprising:

a roller mechanism; and a rolling mechanism, wherein the roller mechanism is adapted to apply heat and pressure on a workpiece supported by the rolling mechanism, wherein the roller mechanism comprises an elastic force applying mechanism that elastically conforms to a shape of the workpiece, wherein the elastic force applying mechanism includes a deformable portion that extends continuously around a circumference and length of a roller wheel of the roller mechanism, and wherein the rolling mechanism is adapted to rotate the workpiece.

2. The heat transferring device of claim 1, wherein the elastic force applying mechanism comprises a deformable rubber portion on the exterior of the roller wheel.

3. The heat transferring device of claim 2, wherein the rolling mechanism comprises a driver adapted to rotate the workpiece.

4. The heat transferring device of claim 1, wherein the workpiece is a pen barrel having a non-circular cross-sectional shape.

5. The heat transferring device of claim 1, wherein the roller mechanism further comprises a suspension frame that includes an upper horizontal rod and a lower horizontal rod, wherein the elastic force applying mechanism is a wheel with a rubber portion having an elasticity sufficient to conform to a shape of the workpiece, and the wheel is fitted over the lower horizontal rod, and wherein the upper horizontal rod is coupled with a pneumatic mechanism.

6. The heat transferring device of claim 1, wherein the elastic force applying mechanism comprises a spring in contact with the roller mechanism, wherein the spring is adapted to elastically conform the roller mechanism to a shape of the workpiece.

7. The heat transferring device of claim 6, wherein the roller mechanism comprises a wheel with a rubber portion and a suspension frame, wherein the suspension frame comprises an upper horizontal rod and a lower horizontal rod, and the wheel is fitted over the lower horizontal rod, and wherein the upper horizontal rod is coupled with a pneumatic mechanism via the spring.

8. The heat transferring device of claim 1, wherein the roller mechanism comprises a roller wheel, wherein the elastic force applying mechanism comprises a deformable rubber portion on the exterior of the roller wheel and a spring in contact with the roller mechanism, and wherein the deformable rubber portion and the spring are adapted to elastically conform to a shape of the workpiece.

9. The heat transferring device of claim 8, wherein the roller mechanism further comprises a suspension frame that includes an upper horizontal rod and a lower horizontal rod, wherein the rubber wheel is fitted over the lower horizontal rod, and wherein the upper horizontal rod is coupled with a pneumatic mechanism via the spring.

10. The heat transferring device of claim 1, wherein the rolling mechanism comprises a motor, a rotating wheel, a base plate, a base, and a die core rod, wherein the base is mounted to the base plate, wherein the die core rod extends through the base and is coupled with the base via a shaft coupling, wherein the rotating wheel is mounted at one end of the die core rod and is connected with the motor via a belt, and wherein the other end of the die core rod is adapted to support the workpiece.

11. The heat transferring device of claim 10, further comprising a height-adjustable pneumatic pulley supporting mechanism provided on the base plate opposite from the base.

12. The heat transferring device of claim 1, further comprising a pneumatic mechanism, wherein the pneumatic mechanism comprises a cylinder with a shaft, and wherein the shaft is coupled to the roller mechanism.

13. The heat transferring device of claim 1, further comprising a heating mechanism connected to the roller mechanism, wherein the heating mechanism is an optical heating cover provided on a roller wheel.

14. The heat transferring device of claim 1, wherein the roller mechanism comprises a roller wheel adapted to rotate upon applying pressure to a rotating workpiece.

15. The heat transferring device of claim 1, wherein the heat transferring device is adapted to heat transfer print on pen barrels.

16. The heat transferring device of claim 1, further comprising a heating mechanism connected to the roller mechanism, wherein the heating mechanism is an electric heating cover provided on a roller wheel.

* * * * *